US005697171A

United States Patent [19]

Phillips

[11] Patent Number: 5,697,171

[45] Date of Patent: Dec. 16, 1997

[54] AIR HEELS

[76] Inventor: Elbert O. Phillips, 2504 Middlecoff Dr., Gulfport, Miss. 39507

[21] Appl. No.: 595,126

[22] Filed: Feb. 1, 1996

[51] Int. Cl.[6] ..... A43B 7/06

[52] U.S. Cl. ..... 36/3 B; 36/3 R

[58] Field of Search ..... 36/3 B, 3 R

[56] References Cited

U.S. PATENT DOCUMENTS

| | | | |
|---|---|---|---|
| 795,502 | 7/1905 | Gareau | 36/3 B |
| 1,453,394 | 5/1923 | Klepac | 36/3 B |
| 2,266,476 | 12/1941 | Riess | 36/3 B |
| 4,835,883 | 6/1989 | Tetrault et al. | 36/3 |
| 4,974,342 | 12/1990 | Nakamura et al. | 36/3 |
| 4,993,173 | 2/1991 | Gardiner | 36/3 |
| 5,010,661 | 4/1991 | Chu et al. | 36/3 |
| 5,138,775 | 8/1992 | Chu | 36/3 B |
| 5,341,581 | 8/1994 | Huang | 36/3 B |
| 5,353,525 | 10/1994 | Grim | 36/3 B X |

FOREIGN PATENT DOCUMENTS

| | | |
|---|---|---|
| 2558044 | 7/1985 | France . |
| 2846507 | 4/1980 | Germany . |
| 533303 | 9/1955 | Italy . |
| 1169598 | 7/1985 | U.S.S.R. . |
| 2189679 | 11/1987 | United Kingdom . |

*Primary Examiner*—Ted Kavanaugh

*Attorney, Agent, or Firm*—Patent & Trademark Service, Inc.; Joseph H. McGlynn

[57] ABSTRACT

An air heel configuration to be used in the construction of a shoe of any type, whether high-heel or flat heel, in which an inner heel portion is activated as the wearer steps downward to move a spring-loaded plunger upward, opening an outlet ball valve, forcing air into a pocket in the inner sole, the air being pushed through ventilation apertures in the toe air, thus cooling the feet. As the heel of the wearer is raised, the outlet ball closes and the intake ball opens, the spring-loaded plunger moves downward, the outlet all closes and the intake ball opens, creating enough force to draw air into the air chamber within the inner heel portion.

2 Claims, 1 Drawing Sheet

AIR HEELS

BACKGROUND OF THE INVENTION

This invention relates, in general, to a device for cooling the feet while wearing shoes and, in particular, to an apparatus to be installed into the heel of a shoe by which the feet may be cooled.

DESCRIPTION OF THE PRIOR ART

In the prior art various types of ventilation systems for shoes are known. For example, U.S. Pat. No. 4,974,342 shows a means of cooling the feet by an inner sole fitted with a suction valve in the heel portion. As the wearer steps down on the suction valve, air is forced through an opening at the front of the heel, the air then flows through the sole portion of the inner sole, the air then passes through exit holes at the toe portion of the inner sole.

U.S. Pat. No. 4,835,883 illustrates a shoe in which the inner sole portion is fitted with flexible vanes that are activated when walking, thus creating a pumping action to draw air into the inner sole area from a conduit on the mid-back portion of the shoe.

The shoe ventilation of U.S. Pat. No. 4,993,173 is by means of longitudinal channels built into a thick flexible sole of a shoe. The shoe sole has an air opening at the rear of the heel and ventilation holes in the toe area.

The ventilation method of U.S. Pat. No. 5,010,661 includes an air inlet hole at the rear portion of the shoe which opens into a circular air chamber in the heel portion of the shoe. A channel extends through the length of the shoe's inner sole with the end of the channel branching off into several tubes extending into the toe area of the shoe.

SUMMARY OF THE INVENTION

The present invention is a unique construction for allowing air to flow through an enclosed pocket in the inner sole area of a shoe and allowing the air to exit through apertures in the inner sole at the toe area of a shoe, thus cooling the feet and allowing the feet to walk in air-cushioned comfort. The air heel of the present invention may be used in any type of shoe, i.e. shoes for women or men, high heels or flats, sneakers, or heavy-duty work shoes.

It is an object of the present invention to provide a means of cooling the feet by the intake of air at the heel section of a shoe each time the wearer places pressure on the heel section of the shoe.

These and other objects and advantages of the present invention will be fully apparent from the following description, when taken in connection with the annexed drawings.

DESCRIPTION OF THE PREFERRED EMBODIMENT

Figure 1:
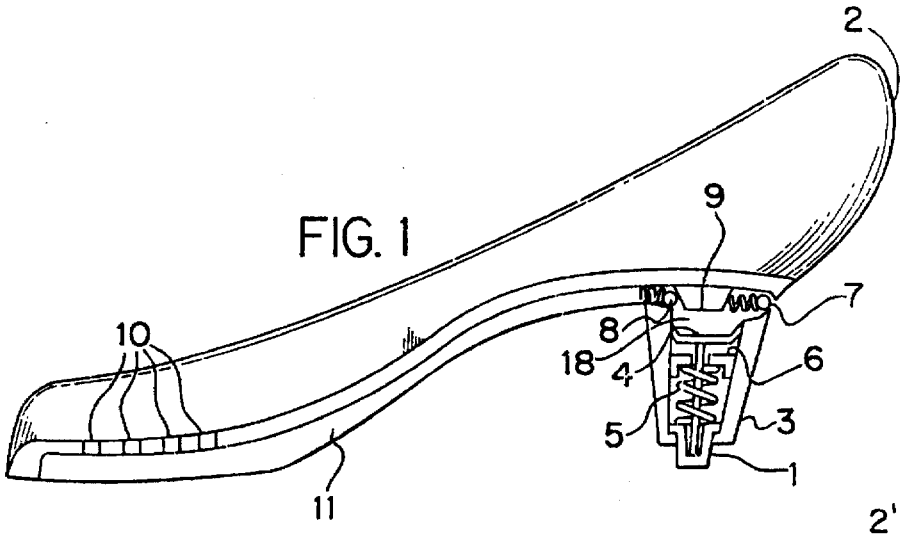
FIG. 1 is a cutaway view of the present invention as constructed for a ladies high-heel slipper.

Referring now to the drawings in greater detail, FIG. 1 shows the installation of the inner heel portion 1 positioned within an outer heel portion 3 in a lady's slipper 2. The inner heel portion 1 consists of a T-shaped plunger 4 which has a stem 23 that passes vertically through a spring 5. Two inverted L-shaped portions 6 are attached to the top of stem 23 (see also FIG. 3) and are fixedly attached to the inner portion of outer heel 3. Positioned in the upper portion of the heel are two ball valves 7, 8 which are normally held against ball valve seats 19, 21 by springs 20, 22, respectfully. The ball valve 7 allows air to pass from outside the shoe to the inside of the heel portion. The ball valve 8 allows air to pass from the inside of the heel portion to the inner sole pocket 11, through apertures 10, and from there into the inside of the shoe 24.

When the wearer presses down on the inner heel portion 1 of the shoe 2, during a normal walking action, the inner heel portion 1 telescopes upward into the outer heel portion 3. As the T-shaped plunger 4 is pressed vertically upward, air in the air chamber 18 forces the spring biased outlet ball valve 8, at the front of the outer heel portion 3, into the inner sole pocket 11. This causes the air to be forced against the upper portion of the heel. The air pressure caused by the plunger 4 compressing the air will push ball valve 8 away from valve seat 21. Air will then be allowed to exit through the inner sole pocket 11 and the apertures 10 to cool the toe area of the shoe 2.

The upper portion of the T-shaped plunger 4 is designed to fit snugly against the U-shaped heel portion 9. When the air is compressed against the upper portion of the heel so that the air pressure, along with the spring 20 will cause the intake ball valve 7 to close. This will prevent air from escaping from the shoe, and will direct all the air into the the inner sole pocket 11.

When the weight of the wearer is removed from the inner heel portion 1, as will be the case during normal walking, the T-shaped plunger 4 will move downward as the spring 5 expands, and air will be drawn into the air chamber 18 of the inner heel portion 1 through the intake ball valve 7. At the same time spring 22 will force the outlet ball valve 8 against the seat 21 which will close the entrance to the inner sole pocket 11.

Figure 2:
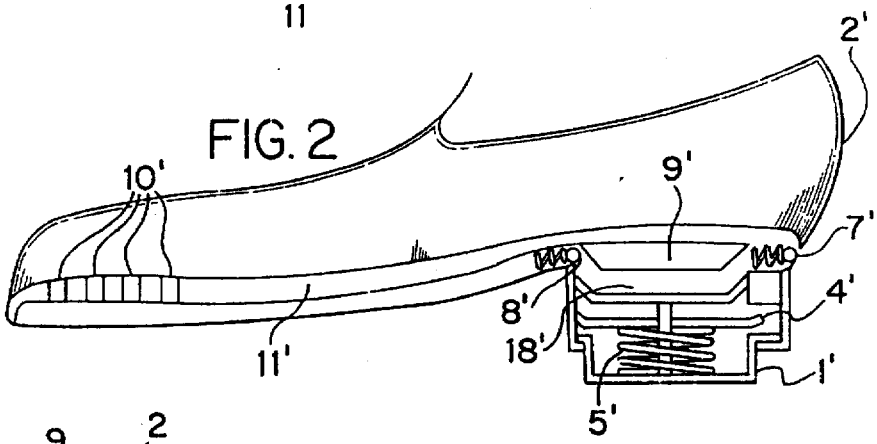
FIG. 2 is a cutaway view of the present invention as shown for usage in a flat heel shoe, either for ladies or gentlemen.

FIG. 2 is a cross-sectional view showing the installation of the inner heel portion 1' in a flat-heeled ladies' or gentlemans' shoe 2'. The structure of the flat-heeled ladies' or gentlemans' shoe 2' is substantially the same as the embodiment in FIG. 1 and the operation of the inner heel portion 1' in the flat-heeled shoe 2' is the same as that of the ladies' high heel shoe as shown in FIG. 1.

Figure 3:
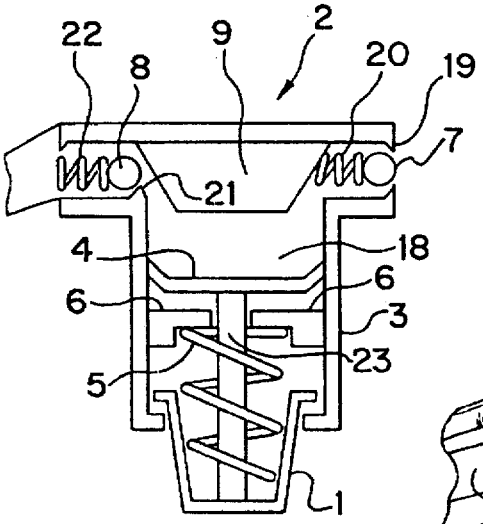
FIG. 3 is a cross-sectional view of the heel section of the present invention showing the construction of the inner telescoping heel section.

FIG. 3 is a cross-sectional view of the air heel construction showing in larger detail the construction of the inner heel portion 1, outer heel portion 3, ball valves 7, 8, valve seats 19, 21, spring 5, and plunger 4, as described in reference to FIG. 1 above.

Figure 4:
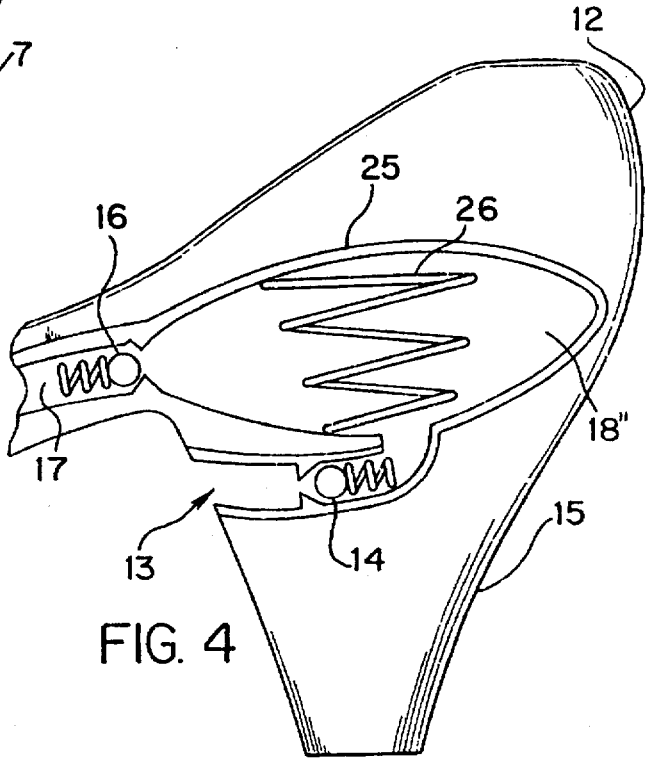
FIG. 4 is a cutaway view of a further embodiment of the present invention.

FIG. 4 is a cutaway view of another embodiment of the present invention. In this embodiment, the shoe 12 is provided with an opening 13 positioned at the front of the heel 15, into which a spring biased intake ball valve 14, similar to ball valve 7 in FIG. 1, is installed. The spring biased outlet ball valve 16 is similarly located at the upper front portion of the heel 15, above valve 13 (which is similar to valve 8 in FIG. 1) and allows air from the air chamber 18" to flow into the pocket 17 in the same manner as described with respect to air chamber 18 and inner sole pocket 11 as described with respect to FIG. 1. The significant difference with respect to the FIG. 4 embodiment is the spring biased plungers 4 and 4' have been eliminated. Instead a portion 25 of the shoe 12 has been made flexible. As the wearer steps down on the heel 15, portion 25 will move downward, compressing spring 26. This will force the air in chamber 18" to be compressed, thereby opening valve 16 which will allow air to pass into pocket 17 and eventually into the interior of the shoe. When the wearer steps forward unto the toe portion of the shoe (during a normal walking motion) the portion will expand under pressure from spring 26 and outside air pressure (which is now greater than the air pressure inside chamber 18" will force ball valve 14 open and a new supply of air will flow into chamber 18", and the cycle will be repeated.

Although the air heel and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A ventilating sole construction for use in combination with a shoe comprising:

a sole including apertures for allowing air to enter an inner portion of said shoe, a conduit joining said apertures with a heel portion of said shoe, said heel portion having a front portion and a rear portion, said front portion being closer to said apertures than said rear portion, a first valve interposed between said apertures and said heel portion for allowing air to travel in one direction from said heel portion to said apertures and, a second valve positioned in said heel portion for allowing air to travel in one direction from outside said shoe into said heel portion, a piston for forcing air from inside said heel through said first valve, and wherein said piston comprises a portion of said shoe forming a chamber, said chamber having a unitary upper and lower portion, said upper portion moving toward said lower portion when a user places weight on said heel portion, said second valve being positioned in said front portion of said heel portion beneath said lower portion of said chamber, whereby when said upper portion moves toward said lower portion, air between said portions will be forced through said first valve into said apertures.

2. The ventilating sole construction as claimed in claim 1, wherein said valve means are ball valves.

* * * * *